United States Patent [19]

Müller-Deisig

[11] 4,007,962

[45] Feb. 15, 1977

[54] CHAIR WITH ADJUSTABLE BACK

[75] Inventor: Wolfgang Müller-Deisig, Schieder-Schwalenberg, Germany

[73] Assignee: Fehlbaum, Basel, Switzerland

[22] Filed: Jan. 5, 1976

[21] Appl. No.: 646,737

[30] Foreign Application Priority Data

Jan. 10, 1975 Switzerland ..... 247/75

[52] U.S. Cl. ..... 297/306; 297/355; 297/408

[51] Int. Cl.[2] ..... A47C 3/00

[58] Field of Search ... 297/300, 306, 312, 344–347, 297/349, 354, 355, 396, 404, 408, 455, 456, 458, 459

[56] References Cited

UNITED STATES PATENTS

| | | | |
|---|---|---|---|
| 2,685,327 | 8/1954 | Pitman | 297/361 X |
| 3,172,699 | 3/1965 | Naughton | 297/355 X |
| 3,189,312 | 6/1965 | Bilancia | 297/346 X |
| 3,837,704 | 9/1974 | Bauer | 297/345 |

*Primary Examiner*—James C. Mitchell
*Attorney, Agent, or Firm*—Ladas, Parry, Von Gehr, Goldsmith & Deschamps

[57] ABSTRACT

A work chair with an upholstered, adjustable seat and back which gives ergonomically correct support to the occupant's spine. The chair back comprises a back support and a shoulder support. The lower end of the back support is pivotally mounted in a rounded buttocks support at the rear of the chair seat. The shoulder support is pivotally mounted at the upper end of the back support. Both parts are contoured to correspond to the natural position of the spine. The inclinations of the back support and shoulder support are independently governed by a gas spring device and a torsion member respectively.

4 Claims, 5 Drawing Figures

II I III
II' I' III'
1
1'
2
2'
3
4
5
6
7
8
9
10
11
12
13
14
15
15'
17
18
19
20

CHAIR WITH ADJUSTABLE BACK

The present invention concerns a chair having an adjustable back with means for the ergonomically correct support of the spine of the occupant of the chair, and having a vertically adjustable seat.

Chair designs which take ergonomic considerations into account are distinguished by the fact that either the inclination of the back or that of the back and the seat can be adjusted to the posture of the chair occupant. The adjustment of the chair is either automatic or is made by hand as the need arises and depends on the activity of the occupant. The purpose of such an adjustable chair is to support the occupant's spine in the optimum fashion. A number of designs have already been proposed with this aim in mind. Some of these designs involve a complex and correspondingly expensive mechanism. Others are not only so designed that adjusting them is a complicated process, with the result that the advantages they offer cannot be fully utilized, but are also fitted with superfluous parts and are therefore too heavy to use. A chair designed in accordance with ergonomic principles must include means capable of adapting to the movements and the anatomy of the human body so that the occupant can work at optimum efficiency over long periods. Thus difficulties of the kind outlined above have a negative rather than a positive effect. A correctly designed chair seat embraces and supports the body up to the pelvis in order to allow the trunk to move as freely as possible. When the occupant of the chair remains seated for a prolonged period of time the natural position of the spine should be maintained. It is in fact possible to adjust the height and inclination of the back to different sitting positions but such adjustments are hardly practicable owing to their time-consuming nature. Experience shows that once the chair back has been adjusted to a certain height it is usually kept at this height which must be suitable for supporting the spine in different sitting positions.

The aim of the present invention is to propose a chair which enables the disadvantages described above to be avoided. In particular, the chair of the invention is capable of reliably supporting the spine, thus significantly improving the characteristics of the chair, without the necessity for any adjustment of the height of the chair back.

The chair of the invention has an adjustable back and is characterized in that the chair seat has a cut-out section which is located in the center of the rounded buttocks support and is of width about ¼ to ⅓ that of the chair seat, that a back support is inserted into this cut-out section so that it practically fills the cut-out section and can tilt forwards and backwards, the vertical profile of the back support defining a surface which corresponds to the natural position of the human spine, and that a shoulder support is pivotally mounted at the upper end of the back support, the shoulder support having a cut-out section opening downwards of width at least that of the upper end of the back support, into which cut-out section the upper end of the back support fits.

An illustratory embodiment of the chair of the invention is described below with reference to the drawing.

Figure 1:
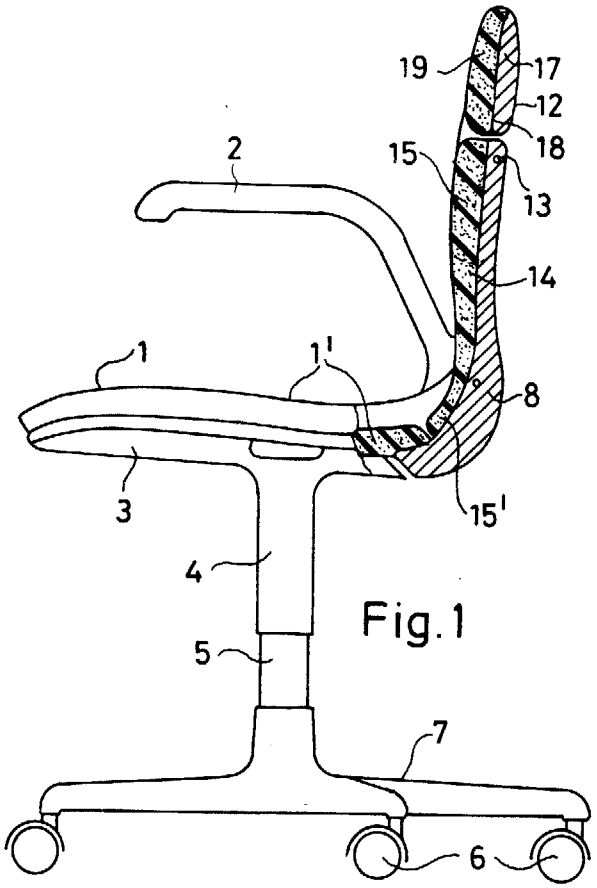
FIG. 1 is a side view of a chair according to the invention with the back cut away.
Figure 2:
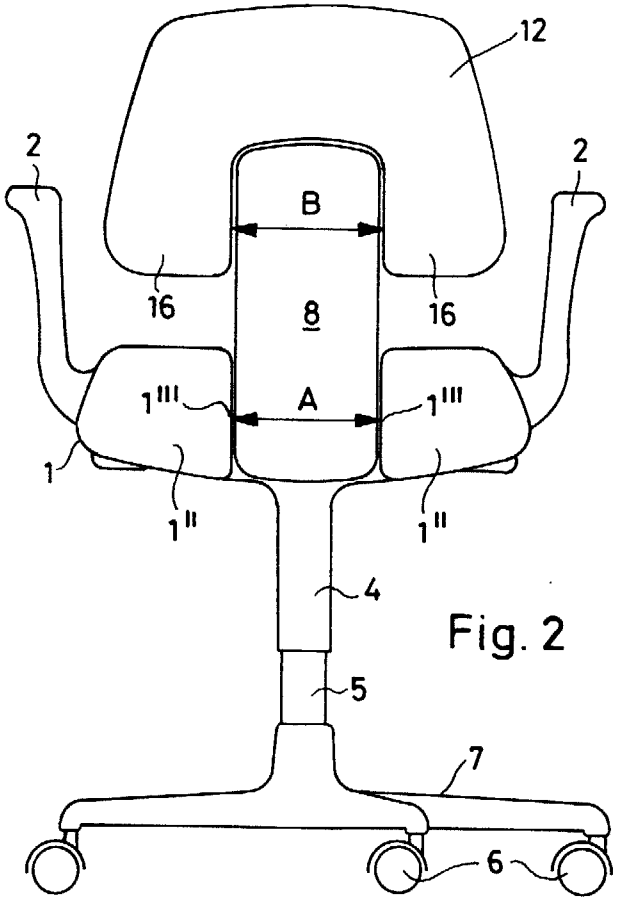
FIG. 2 is a rear view of the chair of FIG. 1 showing the arrangement of the parts of the back.
Figures 3, 4, 5:
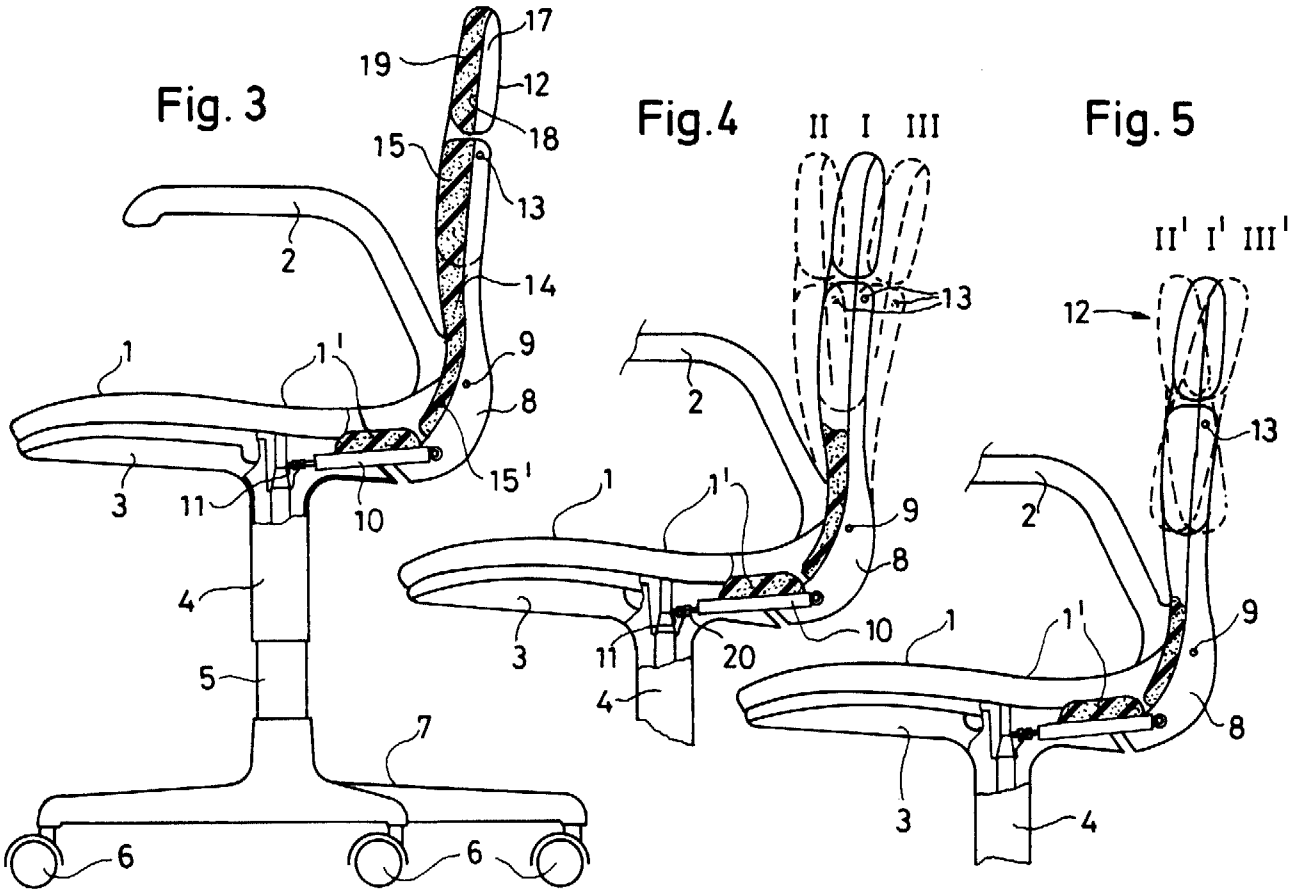
FIG. 3 shows the chair of FIG. 1 with the back partly cut away, as well as details of the adjusting mechanism.
FIG. 4 shows part of the chair of FIG. 3 in order to demonstrate the mobility of the spine support.
FIG. 5 shows part of the chair of FIG. 3 in order to demonstrate the mobility of the shoulder support.

In FIGS. 1 – 5 the seating surface is denoted by 1. Two arm rests 2 are rigidly fixed to the seating surface. The seat plate 3 leads down to a tubular shell 4 which is supported by a spring so that it can move telescopically on a column 5 (FIGS. 1 – 3). The column 5 is supported by a foot 7 having castors 6. The seating surface 1 has upholstery 1' and is rigidly connected to the seat plate 3. The rear end 1'' of the seating surface bends upwards slightly (FIG. 2) and is provided both with means (not shown) for fastening the arm rests 2,2 and also a cut-out section A of width about ⅓ – ¼ that of the seating surface as well as means for mounting a back support 8 so that the latter can pivot about an axis 9. The back support 8 thus has the shape of a two-armed lever. Its lower end is pivotally attached to one end of a gas spring 10 and it is preferably wide enough to fill the cut-out section A. The other end, the piston end, of the gas spring 10 is movably connected to a bracket 11 which in turn is connected to and moves vertically with the seat plate 3. The gas spring is also provided with a mechanical adjusting rod (not shown) which extends laterally under the seat. A shoulder support 12 is pivotally attached to the upper end of the back support and can pivot to a limited extent about an axis 13 (FIG. 5).

Ergonomically correct support of a human body in the sitting position requires the region between the thigh and at least the middle region of the spine to be supported in a way which is optimally adapted to the natural characteristics of the body. The lumbar region of the spine thus assumes particular importance. Experience shows that the relative height of this section differs by only 2 – 3 cm with tall and short people. Thus suitable compensatory measures can be taken instead of making this section of the chair back adjustable. In the present case the back support 8 is made of a stiff material (e.g. a light metal or a plastic) and the side of the back support nearest the occupant has a contoured surface 14 of the correct shape to give the desired support to the spine. This surface 14 is covered with upholstery 15 which gives the desired comfort through support of the central area of the back. As can be seen from FIGS. 1, 3, 4 and 5, the lower part 15' merges with practically no kink into the seat upholstery 1', resulting in an essentially smooth transition from one part to the other. This of course applies to all the positions which can be adopted by the back support 8 as it pivots (FIG. 4).

In order to optimize this comfort the fulcrum 9 about which the inclination of the chair back changes must lie at about the same height as the corresponding fulcrum of the human body, i.e. the thigh joint. The gas spring has two well-known special properties — the position of the piston rod can be chosen using simple control means and the gas spring behaves in a similar way to a normal spring. These properties ensure that the chair back adapts rapidly and precisely to any requirements of the chair occupant by means of the adjusting means. The adjusting means are preferably situated in an area of the seat plate 3 within easy reach of a seated person.

The shoulder support pivotally mounted at the upper end region of the back support 8 has a downwards extending region 16 on each side of a cut-out section B. Together with the central region formed by the back support 8, these regions 16 form a broad support. The rear section 17 of the shoulder support 12 is made, like the back support 8, of a relatively stiff material such as a light metal or a plastic and has a contoured front surface 18. This front surface is covered with upholstery 19.

FIG. 4 illustrates various inclinations of the back support 8. In this Figure the so-called normal position of the chair is represented by full lines. In this position the piston rod 20 of the gas spring 10 is in a position from which it can not only be pushed further into the cylinder but can also be pulled further out. The back support 8 can be tilted from the normal position (I in FIG. 4) either forwards to an inclined position II or backwards to a "flat" position III as required. In keeping with the preferred use of the chair of the invention, this tilting range is not very great — the chair is not intended for use as a easy chair but as a work chair — and comes to about ±10°. As already mentioned the inclination of the back support 8 may be adjusted to practically any intermediate position and in all of these positions the back support yields elastically "backwards" — i.e. in FIGS. 1, 3, 4 and 5 clockwise.

FIG. 5 illustrates in a somewhat exaggerated representation the limited flexibility of the shoulder support 12. The normal position, exactly continuing the back support profile, is designated by I' and the forwards and backwards inclined extreme positions are designated by II' and III' respectively. These extreme positions arise when the trunk is inclined forwards or backwards relative to the general basic posture of the spine. The shoulder support 12 is mounted at the pivot point 13, preferably by means of a torsion member which immediately returns the shoulder support to its normal position on disappearance of the force causing the displacement.

I claim:

1. A chair having an adjustable back with means for the ergonomically correct support of the chair occupant's spine, comprising:

a vertically adjustable seat having a rounded buttocks support and formed with a cut-out section which is located in the centre of the rounded buttocks support and is of width about ¼ – ⅓ that of the chair seat;

a back support which is pivotally mounted with respect to the chair seat so that it can tilt forwards and backwards and so that a lower portion of the back support is fitted in said cut-out section so that it practically fills the cut-out section, the back support having vertical contours defining a surface which corresponds to the natural position of the human spine; and a shoulder support which is pivotally mounted with respect to the back support and which is formed with a cut-out section opening downwards, the back support having an upper portion which is fitted in the cut-out section of the shoulder support, the width of the cut-out section of the shoulder support being at least equal to the width of the upper portion of the back support.

2. A chair as claimed in claim 1, wherein the chair seat, the back support and the shoulder support have upholstery, the contours of which merge into each other without a break in the transitional regions between the seat and the back support and between the back support and the shoulder support.

3. A chair as claimed in claim 1, wherein the position of the back support relative to the seat is determined by the opening distance of a gas spring device which is attached between the lower end of the back support and a bracket on the device supporting the seat.

4. A chair as claimed in claim 1, wherein the shoulder support is elastically held at the upper end of the back support by a torsion member.

* * * * *